US011459774B2

(12) United States Patent
Fahle et al.

(10) Patent No.: US 11,459,774 B2
(45) Date of Patent: Oct. 4, 2022

(54) PANELS WITH A DETACHABLE PROTRUDING LIP FOR WALL- , CEILING- OR FLOOR COVERINGS

(71) Applicant: Xylo Technologies AG, Niederteufen (CH)

(72) Inventors: Daniel Fahle, Dresden (DE); Max Wendt, Dresden (DE); Uwe Lippert, Dresden (DE)

(73) Assignee: Xylo Technologies AG, Niederteufen (CH)

( * ) Notice: Subject to any disclaimer, the term of this patent is extended or adjusted under 35 U.S.C. 154(b) by 0 days.

(21) Appl. No.: 16/632,151

(22) PCT Filed: Jul. 18, 2017

(86) PCT No.: PCT/EP2017/068140
§ 371 (c)(1),
(2) Date: Jan. 17, 2020

(87) PCT Pub. No.: WO2019/015746
PCT Pub. Date: Jan. 24, 2019

(65) Prior Publication Data

US 2020/0232225 A1 Jul. 23, 2020

(51) Int. Cl.
*E04F 15/02* (2006.01)
*E04F 13/08* (2006.01)

(52) U.S. Cl.
CPC .... *E04F 15/02038* (2013.01); *E04F 13/0894* (2013.01); *E04F 2201/0138* (2013.01);
(Continued)

(58) Field of Classification Search
CPC ... E04F 15/02; E04F 15/02038; E04F 15/045; E04F 15/10; E04F 2201/023;
(Continued)

(56) References Cited

U.S. PATENT DOCUMENTS 3,538,660 A * 11/1970 Moor ..... E04B 2/7451 52/242
6,101,778 A * 8/2000 Mørtensson ..... E04B 1/6129 52/582.1
(Continued)

FOREIGN PATENT DOCUMENTS

CN 1203649 A 12/1998
CN 1656291 A 8/2005
(Continued)

OTHER PUBLICATIONS

Chinese Office Action with English translation, dated Dec. 17, 2020, pp. 1-20, Chinese Patent Application No. 201780093317.6, China National Intellectual Property Administration, Beijing, China.
(Continued)

*Primary Examiner* — Jessie T Fonseca
(74) *Attorney, Agent, or Firm* — Crowell & Moring LLP

(57) ABSTRACT

A panel for wall-, ceiling- or floor coverings is provided, the panel comprising an upper side, a lower side, and front ends, defining a circumference of the panel in the installed state, and at least one front end is protruded with respect to the circumference by a detachable protruding lip formed at the lower side, one horizontal locking groove at the lower side, characterized in that the protruding lip has a predetermined break-off surface. Furthermore, methods are provided for manufacturing wall-, ceiling- and/or floor coverings comprising or consisting of a plurality of the panels.

17 Claims, 3 Drawing Sheets

(52) U.S. Cl.
CPC ... *E04F 2201/023* (2013.01); *E04F 2201/042* (2013.01); *E04F 2201/043* (2013.01); *E04F 2201/044* (2013.01); *E04F 2201/0523* (2013.01); *E04F 2290/00* (2013.01)

(58) Field of Classification Search
CPC ..... E04F 2201/043; E04F 2201/044; E04F 2201/049; E04F 2201/115; E04F 2201/0138; E04F 2201/0146; E04F 2201/0153; E04F 2201/0176; E04F 2201/0523; E04F 2201/0552; E04F 2201/0588; E04F 13/0894; E04F 2201/042; E04F 2201/041; E04F 2201/0547; E04F 2201/07; E04F 2290/00
USPC ..... 52/309.1, 309.13, 582.1, 582.2, 586.1, 52/586.2, 588.1, 591.1, 592.2; 403/339, 403/364
See application file for complete search history.

(56) References Cited

U.S. PATENT DOCUMENTS 6,421,970 B1 * 7/2002 Martensson ..... E04B 1/6129 52/282.1
6,446,405 B1 * 9/2002 Pervan ..... E04F 15/102 52/403.1
6,685,391 B1 * 2/2004 Gideon ..... E01D 19/02 405/16
7,131,242 B2 * 11/2006 Martensson ..... E04B 1/6129 52/591.3
7,726,088 B2 * 6/2010 Muehlebach ..... E04F 15/02 52/582.1
7,980,039 B2 * 7/2011 Groeke ..... F16B 5/0056 52/582.2
8,029,880 B2 * 10/2011 Liu ..... E04F 15/02 428/60
8,091,238 B2 * 1/2012 Hannig ..... E04F 15/02 29/897.32
8,302,367 B2 11/2012 Schulte
8,850,769 B2 * 10/2014 Pervan ..... E04F 15/04 52/480
9,314,936 B2 * 4/2016 Pervan ..... B26D 1/14
2006/0073320 A1 4/2006 Pervan et al.
2009/0217615 A1 * 9/2009 Engstrom ..... E04B 1/54 52/588.1
2009/0249733 A1 * 10/2009 Moebus ..... E04F 15/04 52/588.1
2010/0031594 A1 2/2010 Liu et al.
2010/0043333 A1 * 2/2010 Hannig ..... E04F 15/02 52/582.2
2011/0167750 A1 * 7/2011 Pervan ..... E04C 2/30 52/588.1
2011/0271631 A1 * 11/2011 Engstrom ..... E04F 15/02005 52/582.2
2011/0271632 A1 * 11/2011 Cappelle ..... F16B 5/0056 52/582.2
2012/0042595 A1 * 2/2012 De Boe ..... E04F 15/02 52/309.13
2012/0180416 A1 * 7/2012 Perra ..... E04C 2/40 52/309.1
2013/0180193 A1 * 7/2013 Bossuyt ..... E04B 1/54 52/309.13
2013/0276398 A1 * 10/2013 Hannig ..... C10L 11/04 52/588.1
2013/0309441 A1 * 11/2013 Hannig ..... F16B 5/0056 428/100
2015/0240500 A1 * 8/2015 Stevens, Jr. ..... E04F 15/107 52/588.1
2015/0267418 A1 * 9/2015 Vermeulen ..... E04F 15/105 52/582.2
2019/0257092 A1 8/2019 De Rick et al.

FOREIGN PATENT DOCUMENTS

| | | | |
|---|---|---|---|
| CN | 101035627 | A | 9/2007 |
| CN | 101490346 | A | 7/2009 |
| CN | 103547749 | A | 1/2014 |
| CN | 103748299 | A | 4/2014 |
| CN | 106103862 | A | 11/2016 |
| DE | 196 01 322 | A1 | 5/1997 |
| EP | 1 279 778 | A2 | 1/2003 |
| EP | 1 650 375 | A1 | 4/2006 |
| WO | WO 97/21011 | | 6/1997 |
| WO | WO 97/47834 | A1 | 12/1997 |
| WO | WO 01/66877 | A1 | 9/2001 |
| WO | 1 282 752 | A1 | 11/2001 |
| WO | WO 03/025307 | A1 | 3/2003 |
| WO | WO 03/083234 | A1 | 10/2003 |
| WO | WO 2004/063491 | A1 | 7/2004 |
| WO | 1 730 366 | A1 | 10/2005 |
| WO | WO 2007/142589 | A1 | 12/2007 |
| WO | WO 2012/126046 | A1 | 9/2012 |
| WO | WO 2013/025165 | A1 | 2/2013 |
| WO | WO 2015/155312 | A1 | 10/2015 |

OTHER PUBLICATIONS

International Search Report and Written Opinion, issued in International Application No. PCT/EP2017/068140, dated Apr. 18, 2018, pp. 1-13, European Patent Office, Rijswijk, Netherlands.
Second Chinese Office Action with English Translation for Chinese Patent Application No. 2017800933176, dated Aug. 3, 2021, pp. 1-8, China National Intellectual Property Administration, Beijing, People's Republic of China.
Canadian Office Action for Canadian Patent Application No. 3,069,478 dated Apr. 11, 2022, 4 pgs.

* cited by examiner

PANELS WITH A DETACHABLE PROTRUDING LIP FOR WALL- , CEILING- OR FLOOR COVERINGS

CROSS-REFERENCE TO RELATED APPLICATIONS

This application is a 371 nationalization of international patent application PCT/EP2017/068140 filed Jul. 18, 2017, the entire contents of which is hereby incorporated by reference.

TECHNICAL FIELD

The present invention relates to panels with a detachable protruding lip for wall-, ceiling- or floor coverings. Furthermore, it relates to a method for manufacturing wall-, ceiling- or floor coverings comprising or consisting of a plurality of such panels.

Background Panels for wall-, ceiling- or floor coverings are known in the art. EP 1 282 752 A1 relates to panels of a laminate floor, comprising coupling elements which enable a form-fitting connection between the panels. A first and a second panel have coupling elements on one side in each case, whereby the first panel can be connected form-fittingly to the second panel by a rotary movement. The first and second panels additionally have on a further side in each case coupling elements which are so configured that the second panel is connectable form-fittingly to the first panel by lowering said second panel with respect to the first panel. The first panel includes a projecting edge positioned laterally on its underside as an additional coupling element serving to connect the panels by lowering. The second panel includes a projecting edge positioned laterally on its upper side and serves to connect the panels by lowering, which projecting edge projects further in comparison to lateral portions of this panel located below said projecting edge. The projecting edge of the second panel has on its underside a first projecting locking element which in the assembled state of the two panels engages in a corresponding first recess in the projecting edge on the underside of the first panel. The first recess is openly accessible when the first panel rests with its underside on a floor. The two panels include further coupling elements serving to connect the panels by lowering, which lock the two panels form-fittingly in a vertical direction with respect to the surface of the panels. In the assembled state of the two panels the further coupling elements serving to join the panels by lowering are located below the edge projecting on the upper side. In the assembled state of the two panels a plurality of gaps between the coupling elements of the first and second panels serving to connect the panels by lowering are present at the locations which are not used for mechanical connection. The gaps are provided between the coupling elements in such a way that no free play remains at the connecting joint between the two panels.

WO 97/047834 A1 refers to a floor covering, consisting of hard floor panels which, at least at the edges of two opposite sides, are provided with coupling parts, cooperating with each other, substantially in the form of a tongue and a groove, characterized in that the coupling parts are provided with integrated mechanical locking means which prevent the drifting apart of two coupled floor panels into a direction perpendicular to the related edges and parallel to the underside of the coupled floor panels.

WO 03/025307 A1 relates to floorboards for installation of floors in herring-bone pattern which are formed with two opposite sides inverted relative to each other.

WO 04/63491 A1 refers to a floor covering, of the type consisting of hard floor panels, which are manufactured of a plate material and which, at least at a number of sides, are provided with coupling parts, characterized in that the floor panels are configured such that, in joined condition, they represent a herringbone pattern, whereby the sides of the floor panels coincide with transition edges of the herringbone pattern.

WO 01/066877 A1 relates to a vertically joined flooring material comprising floor elements with a mainly triangular, square, rectangular, rhomboidal or polygonal shape. The floor elements are provided with edges which are provided with joining members, a lower side and a decorative top surface. The flooring material comprises a combination of at least two types of floor elements, which types comprise female floor elements and male floor elements. The female floor element is provided with a female joining member on at least half of the number of its edges and a male joining member on less than half of the number of its edges. The male floor element is provided with a male joining member on at least two thirds of the number of its edges and a female joining member on less than one third of the number of its edges. An optional joining profile possibly constitutes a junction between two adjacent male joining members of two adjacent floor elements.

WO2007/142589 A1 refers to a connection member for massive dynamic bodies comprising a longitudinal body having a cross section that includes two base plates aligned in opposite directions adapted to extend along the bottom sides of two adjacent dynamic bodies, wherein the base plates are provided with projections directed upwards; an upright shank with two shank legs, the shank legs transforming into the respective base plates; two spring arms extending out from the upper body of the shank essentially parallel to the base plates, wherein the spring arms are bent upwards and bent inwards towards the shank such that a lower section is essentially parallel to an upper section, each respective upper section of the spring arms being provided with a projection directed upwards; and a supporting head arranged on top of the upper body of the shank in a mounted position, and a method of connecting dynamic bodies such as wood pieces where at least two wood pieces having circumferential recesses are connected to at least one connecting member.

US 2010/0031594 A1 relates to a hardwood floor system with press down locking mechanism. Each floor board is equipped with both male and female locking mechanisms. The male locking mechanism of a floor board can be locked into the female locking mechanism of an adjacent floor board by simply exerting downward force on the floor board. The female locking mechanism is equipped with a spring slot that enables easy engagement of male and female locking mechanisms.

EP 1 730 366 A1 refers to a panel element for laying on floors, walls and/or ceilings, comprising a rectangular basic body. The basic body has a first head edge, a second head edge opposed to the first head edge, a first longitudinal edge extending perpendicularly to the first head edge, and a second longitudinal edge opposed to the first longitudinal edge. Both head edges and both longitudinal edges are contoured so as to allow a connection with an adjacent panel element at each edge, and wherein the first longitudinal edge has a groove and the second longitudinal edge has a corresponding tongue. A shorter upper leg and longer lower leg are provided on the first longitudinal edge, wherein the contours of the head edges each have an undercut so as to allow an engagement of the tongue of the second longitudinal edge in the contour of each head edge of an adjacent, identical panel element. A step is provided on each head edge adjoining the undercut and an engagement facility is provided between the lower leg of the first longitudinal edge and the step so as to allow a connection between the groove of the first longitudinal edge and each head edge of an adjacent, identical panel element.

SUMMARY OF THE INVENTION

The panel elements known in the prior art have the disadvantage that especially for herringbone patterns they provide little or no locking at all in a vertical direction away from laying the plane. Often locking systems are employed on rather thin panels, so that complicated machining of delicate profile elements with many undercuts is difficult and expensive and delicate locking elements are often damaged and deformed, especially when they are used for flooring.

Based thereon, the objective of the present invention was the provision of a panel with a locking system which is stable in locking, simple to manufacture with only a low risk for damaging the locking elements, allows for easy and interesting installations and allows laying any desired pattern.

This objective is achieved by a panel for wall-, ceiling- or floor coverings. This panel comprises an upper side, a lower side, and front ends, defining a perimeter of the panel in the installed state and at least one front is protruded with respect to the perimeter by a detachable protruding lip formed at the lower side, one horizontal locking groove at the lower side, characterized in that the protruding lip has a predetermined break-off surface.

Another aspect relates to a method for manufacturing wall-, ceiling- and/or floor coverings comprising or consisting of a plurality of panels. According to said method, a first panel at its front end is connected with the corresponding front end of the neighbored panel by removing the protruding lip at the predetermined break-off surface and by joining the protruding lip of the first panel with the neighbored panel.

Furthermore, another aspect relates to a further method for manufacturing wall-, ceiling- and/or floor coverings comprising or consisting of a plurality of panels described herein. According to this method, an adhesive or a glue is provided onto at least a part of the surface of the protruding lip for providing a locking function in the vertical direction or the adhesive or a glue is provided onto at least a part of the front end.

PREFERRED EMBODIMENTS

Panel

In general, panels are rectangular and have a regular shape. In the gist of present invention regular shapes have sides that are all equal and interior (inside) angles that are all equal, whereas irregular shapes have sides and angles of any length and size. The invention is not limited to rectangular panels having a regular shape, but the inventive concept is also applicable to panels having an irregular shape.

According to one preferred embodiment of the present invention, the predetermined break-off surface is formed by one or more start notches, one or more cuttings, preferably laser cuttings, one or more drillings, one or more milled slots, a density gradient within the panel, by means of introducing a film, adhesives, binders and/or primers and/or by using different materials in the area of the predetermined break-off surface.

According to another preferred embodiment of the present invention, the protruding lip comprises at least one horizontal locking element, being suitable for engaging in the horizontal locking groove of a neighbored panel, wherein the protruding lip of said neighbored panel has been removed.

A horizontal locking element in the spirit of the present invention has a locking effect in horizontal direction, whereas a vertical locking element has a locking effect in vertical direction. According to the present invention the horizontal direction is the laying direction of the panels and the vertical direction is the direction at right angle to the laying direction.

A further preferred embodiment of the present invention envisages that at least two detachable protruding lips are fixed at the panel, more preferably at opposite sides of the panel.

According to another preferred embodiment, the panel has four sides and is rectangular and protruding lips are fixed at all four sides of the panel.

According to another preferred embodiment of the present invention, all front ends are protruded with respect to the perimeter by a detachable protruding lip formed at the lower side.

According to a further preferred embodiment of the present invention, the horizontal locking element additionally retains the neighbored panel in vertical and/or horizontal direction.

According to another preferred embodiment of the present invention, a vertical locking groove is incorporated in the front end. Preferably the vertical locking groove can accommodate vertical locking means.

According to a further preferred embodiment of the present invention, the panel comprises, preferably consists of, a material selected from the group consisting of MDF (=medium density fiber board), HDF (=high density fiber board), cork, OSB (=oriented strand board), solid wood, plywood, plastics, preferably PVC (=polyvinylidene chloride), cement fibers, basalt, rock wool, ceramics, genuine stone, metal, preferably aluminum or steel panel, plastics, chipboard, laminate floorboards and mixtures or pairings thereof.

Another preferred embodiment of the present invention envisages that the panel consists of laminate floorboards made of MDF or HDF or PVC or mixtures thereof. In case that PVC is used it is preferable that the PVC is free of softeners.

According to another preferred embodiment of the present invention, the front end comprises at the upper side a vertical locking groove over the whole length of the front end or at least over parts of the length of the front end.

A further preferred embodiment envisages that a vertical looking groove is formed at the horizontal locking element.

According to a further preferred embodiment, the protruding lip comprises a trough. Said embodiment is in particular preferred when joining is carried out by applying an adhesive or a glue. The trough is suitable for the accommodation of the adhesive or the glue and since the user can dose the amount of the adhesive or glue, oozing of said adhesive or glue oozes over the edges during the joining process is prevented. Furthermore, it is possible to fix a double-sided adhesive in the trough during the manufacturing process of the protruding lip.

According to another preferred embodiment, the predetermined break-off surface is formed by one start notch and one end notch. Said embodiment is in particular preferred when the panel with the protruding lip both consists of MDF or HDF. The one end notch is preferably arranged in the horizontal locking groove.

Another preferred embodiment envisages that the panel has a rectangular shape. For a rectangular shape the length of the panel is an integer multiple of the width, such as 1:1, 1:2, 1:3, 1:4, 1:5, 1:6, 1:7, 1:8, 1:9, 1:10, 1:11, 1:12 etc., preferably 1:6. For other ratios between length and width a herringbone pattern cannot be obtained.

According to a further preferred embodiment, the protruding lip comprises a trough, more preferably said through comprises a double-sided adhesive tape.

According to another preferred embodiment, the protruding lip and the core of the panel consist of different materials. Cheap materials like e.g. plastics are preferred for the protruding lip. In one preferred embodiment the protruding lip comprises, preferably consists of a material selected from the group consisting of MDF, HDF or plastics and the core comprises, preferably consists of a material selected from the group consisting of MDF, HDF or plastics, preferably PVC more preferably the protruding lip consists of plastic and the core consists of MDF or HDF or PVC or mixtures thereof.

Another preferred embodiment of the present invention envisages that the bend surface of the protruding lip is beveled. This embodiment has the advantage that the risk of damaging the panel during the laying process is reduced.

According to another preferred embodiment, the start notch is oriented in a vertical distance in the range from 0.1 to 10 mm above the upper lip surface for forming a crack gap. Said crack gap can accommodate any irregular break off surface.

According to another preferred embodiment, a decorative layer and/or an abrasion resistant layer is arranged on the upper side.

Another preferred embodiment, envisages that a layer for insulating footstep sounds and/or a counterdraw layer is oriented below the lower side. More preferably the panel comprises an abrasion resistant layer, a decorative layer, a counterdraw layer and a layer for insulating footstep sounds.

The protruding lip can in principle be fixed to the panel by all fixing techniques known in the arts, preferably by gluing or adhering.

Methods

The present invention relates to two methods for manufacturing wall-, ceiling- and/or floor coverings consisting of a plurality of panels. The wall-, ceiling- and/or floor covering is made of a plurality of panels and said panels are laid during the manufacturing process of the panel.

According to the first method the locking function in vertical direction is achieved by mechanical means, whereas no mechanical means are required for locking in vertical direction by the second method.

First Method

According to one preferred embodiment of the first method according to the present invention the protruding lip of the first panel comprises at least one horizontal locking element being suitable for engagement in the horizontal locking groove of the neighbored panel, whose protruding lip has been removed, wherein during joining the at least one horizontal locking element is incorporated in the horizontal locking groove.

According to a further preferred embodiment of the present invention the first panel and the neighbored panel each have a vertical locking groove at their front end and during joining an insertable locking element connecting the vertical locking grooves is introduced in the vertical locking grooves.

Second Method

According to a preferred embodiment of the present invention no mechanical means are provided for locking in the vertical direction. In this embodiment the protruding lip preferably comprises a trough for the accommodation of an adhesive or the through comprises a double-sided adhesive tape.

Independent on the method chosen for laying the panel, there is no limitation regarding the laying pattern. Both methods allow laying the panels parallels to each other or laying the panels vertically to each other, as needed for herringbone patterns or other complex patterns.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same.

DESCRIPTION OF PREFERRED EMBODIMENTS

Figure 1:
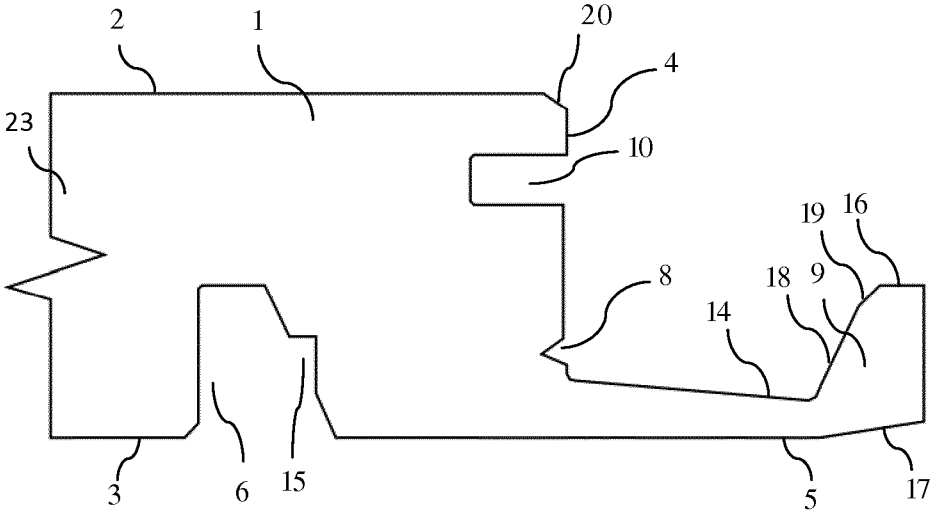
FIG. 1 shows a side view of a panel (1) with a detachable protruding lip (5) according to the present invention.

FIG. 1 shows a side view of a cut off panel (1), focusing on the locking system according to the present invention. A horizontal locking element (9) is mounted on a protruding lip (5). The horizontal locking element is designed in such a way, that it fits into a horizontal locking groove (6) of a neighboring panel (1') and thereby provides locking in a horizontal direction. The panel (1) has an upper side (2), which may or may not be decorated or covered by an additional abrasion resistant surface. Furthermore, the panel (1) may or may not have a decorative bevel (20) at its edge. With the embodiment shown in FIG. 1, a start notch (8) is created in the panel (1). By applying a downward force at the end of the protruding lip (5), for example by applying a downward pressure by hand on the abutment surface (16), a lever is created by the protruding lip (5). This lever is further lengthened by the start notch (8) which thereby acts as starting point for a crack. This crack intentionally propagates from the start notch (8) to an end notch surface (15).

Figure 2:
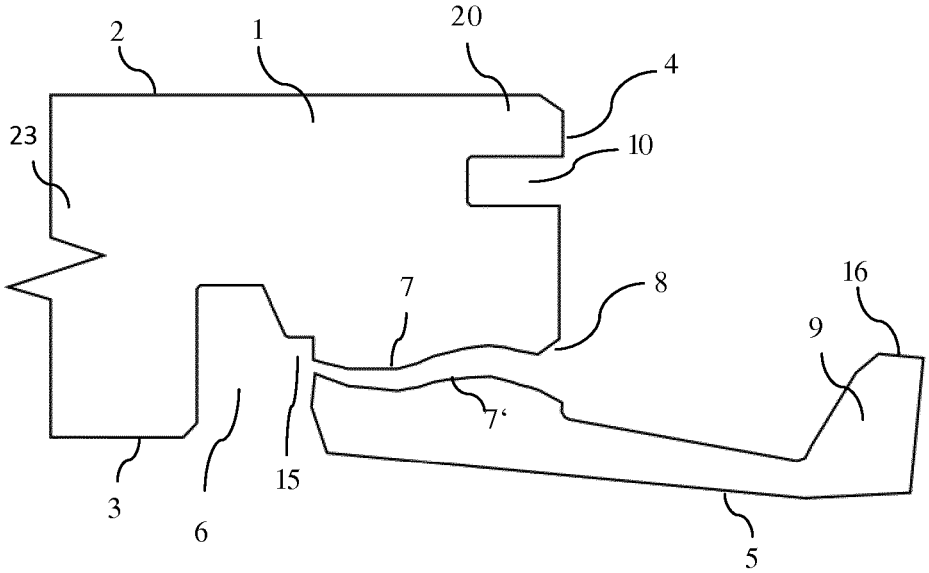
FIG. 2 also shows a side view of a panel (1) with a detachable protruding lip (5) according to the present invention, wherein the protruding lip (5) with a horizontal locking element (9) is now detached.

FIG. 2 shows another side view of a cut off panel (1) according to the invention. FIG. 2 shows how the protruding lip (5) with the horizontal locking element (9) is detached from the panel (1) along a predetermined break off surface (7, 7').

Figure 3:
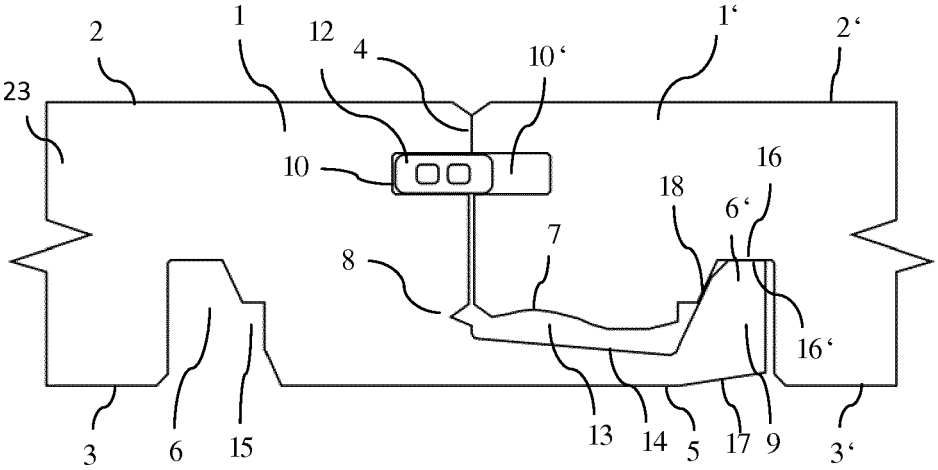
FIG. 3 shows a side view of two panels (1,1') which are joined together by a horizontal and vertical locking system. In this embodiment, vertical locking is achieved by an insertable locking element (12).

FIG. 3 shows a side view of two panels (1, 1') which are now joined together. Here the horizontal locking element (9) on the protruding lip (5) of a first panel (1) is fitted into the horizontal locking groove (6') of a second panel (1') and thereby prevents any movement in the horizontal direction. The protruding lip (5) of the second panel (1') has been removed by detachment along the predetermined break off surface (7) in order to achieve said horizontal locking.

In the embodiment of FIG. 3, vertical locking is simultaneously achieved in several ways:

Firstly, vertical locking against a movement of both panels (1,1') towards the lower side of the panels (3,3') is prevented by the substrate onto which the panels (1,1') are mounted, which is the floor, the wall, the ceiling or any further coverings thereof.

Secondly, vertical locking against a movement of the second panel (1') towards the lower side if the panel (3') is prevented by the abutment surfaces (16,16').

Thirdly, an insertable locking element (12) is provided which is inserted into the vertical locking grooves (10,10') of both panels (1,1'). This insertable locking element (12) together with the locking grooves (10,10') prevent vertical movement of both panels in both vertical directions, towards the lower sides (3,3') and the upper sides (2,2'). The insertable locking element may either be inserted into the right groove by the person installing the panels, or by being pre-mounted in the factory. In the case that the insertable locking elements (12) are pre-mounted at the production facility, a user friendly solution is obtained by mounting the insertable locking elements (12) into the vertical locking grooves (10,10') on all four sides of rectangular panels, such that the person installing the panels can remove them together with the detachable protruding lips (5) as required for the particular laying pattern.

It is clear that with the many different types of possible materials or material combinations out of which the panels (1) according to the invention can be made, it cannot be expected that the predetermined break-off surface (7) is always a smooth and straight, perfect surface. For panel materials such as e.g. wood based fiber boards known as MDF/HDF laminate, a generally irregular break-off surface (7) is rather to be expected. The geometry of the break off surface (7) can only be predetermined within limits. This is why it is important to choose the start notch (8) at some vertical distance above the upper lip surface (14). By this measure, a crack gap (13) is achieved, which can accommodate any irregular break off surface (7). This is important in that only the abutment surfaces (16,16') are intended to touch in the horizontal plane and not the upper lip surface (14) somewhere at the irregular break off surface (7), as this would result in panels which have their respective upper sides (2,2') in different planes thereby resulting in an irregular paneled surface. It is also important to add a well defined end notch surface (15) into which the crack will exit because it enables the crack to travel the shortest available distance. In the embodiments of FIGS. 1 to 3 and 5, a slightly inclined contact surface (18) is chosen, which enables horizontal locking. The inclination of the locking surface (18) enables to pull two panels (1,1') towards each other in the final laying stage and is chosen to be 40 to 80 degrees to laying plane. A further inclined surface on the horizontal locking element (9) between the locking surface (18) and the abutment surface (16) additionally also serves as a guiding surface (19) to help to align the panels during laying.

For those panel materials or combinations of materials which exhibit some elasticity, the thickness of the protruding lip (5) is carefully chosen and a further inclined bend surface (17) is added below the horizontal locking element (9) so that when a second panel (1') is joined by generally pushing it downward, the protruding lip (5) can be elastically deformed to some degree, thereby providing a slight snapping action which further holds the panels together.

Figure 4:
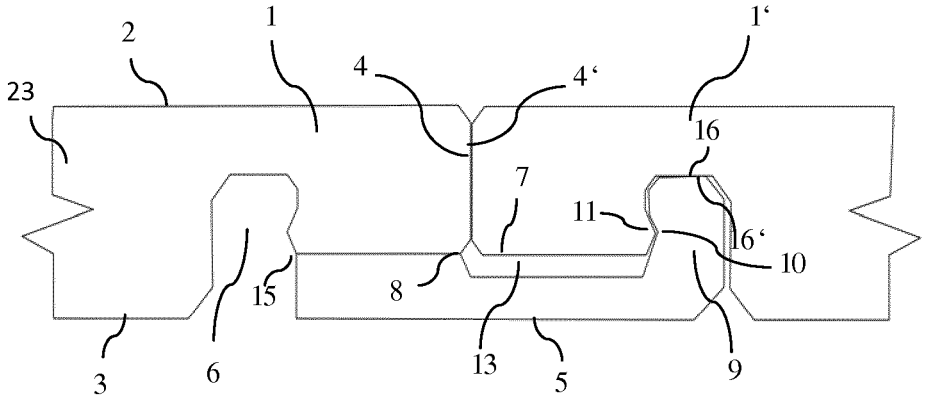
FIG. 4 shows a side view of two panels (1,1') joined by an alternative embodiment of the locking system according to the present invention.

FIG. 4 shows a side view of two cut off panels (1, 1') joined by an alternative embodiment of the locking system according to the invention. In this embodiment, vertical locking is achieved by a vertical locking element (11) which interacts with a vertical locking groove (10) on the horizontal locking element (9). For some panel materials or material pairings it can be a mechanical or an economical advantage to provide the protruding lip (5), together with the horizontal locking element (9) by gluing the protruding lip (5) to a panel (1) at the factory, so that the glued surface then acts as predetermined break off surface. Such a solution can be chosen e.g. for ceramic panels or tiles with a protruding lip (5) made of a plastic material.

Figure 5:
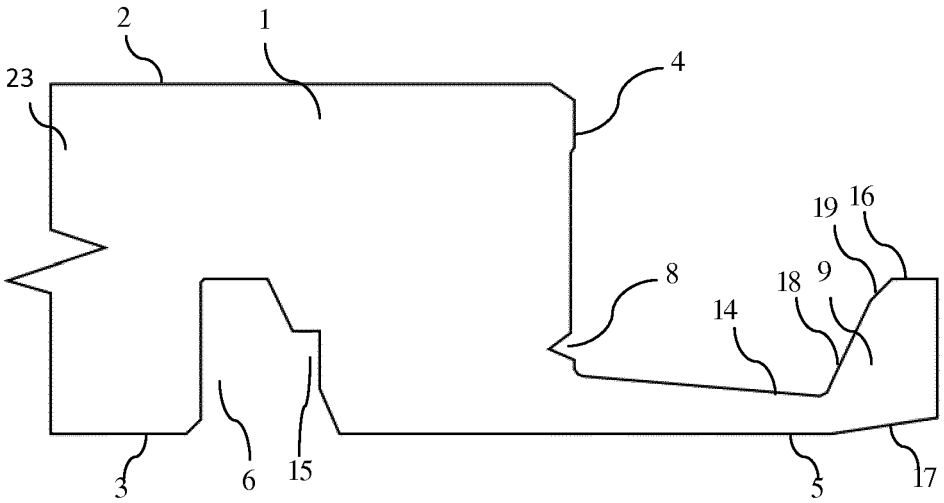
FIG. 5 shows a side view of a panel (1,1') with an alternative embodiment of the locking system according to the present invention. In this embodiment, gluing is intended to achieve vertical locking.
Figure 6:
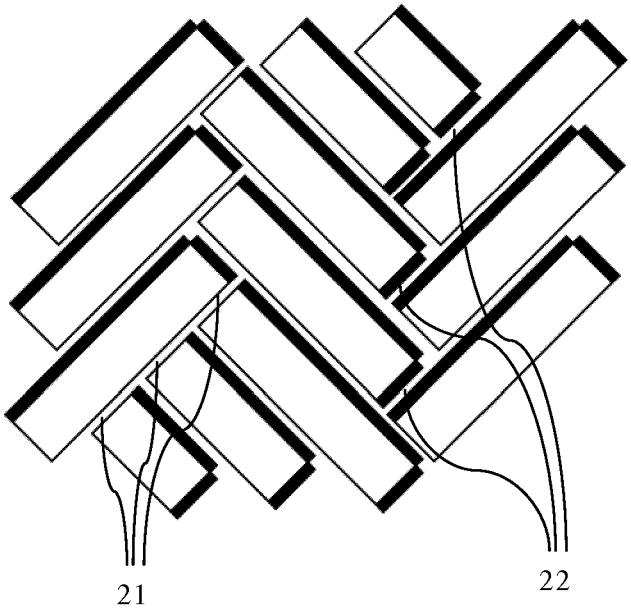
FIG. 6 shows a top view of a multitude of panels known from the prior art. Panels with such locking elements are not well suited for e.g. herringbone laying patterns. Panels that have a tongue shaped element on one of the long and one of the short sides and a groove shaped element on the other long and short sides.

FIG. 5 shows a side view of a panel (1) with another alternative embodiment of the locking system according to the invention. In this embodiment, no mechanical means are provided for locking in the vertical direction away from the laying plane. However, since the protruding lip (5) together with the front end of the panel (4) and the horizontal locking element (9) form a trough, an adhesive or a glue may be provided onto the upper lip surface to provide the locking function in the vertical direction away from the laying plane.

In the panel with a detachable protruding lip according to the present invention a very good balance between the properties "easy removable" before the laying process and ensuring a "stable connection" after the laying process has been realized. There is only a small risk that the panel is damaged when removing the protruding lip, because the protruding lip can be removed after laying, so that forces acting on the panel are not critical. Furthermore, the protruding lip is easily removable manually without using any tools.

LIST OF REFERENCE SIGNS

1, 1': Panel
2, 2': Upper side of the panel
3, 3': Lower side of the panel
4, 4': Front end of the panel
5: Protruding lip
6: Horizontal locking groove
7, 7': Predetermined break-off surface
8: Start notch
9: Horizontal locking element
10: Vertical locking groove
11: Vertical locking element
12: Insertable locking element
13: Crack gap
14: Upper lip surface
15: End notch
16, 16': Abutment surface
17: Bend surface
18: Locking surface
19: Guiding surface
20, 20': Decorative bevel

21: Missing locking elements
22: Superfluous locking elements
23: Core of the panel To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

The invention claimed is:

1. A panel for wall-, ceiling- or floor coverings, the panel comprising:

an upper side, a lower side, and a plurality of front ends, the upper side, the lower side and the front ends defining a perimeter of the panel in an installed state;

a detachable protruding lip formed at the lower side, wherein the detachable protruding lip protrudes from at least one of the front ends with respect to the perimeter; and one horizontal locking groove at the lower side, wherein the detachable protruding lip comprises one or more start notches, one or more cuttings, one or more laser cuttings, one or more drillings, one or more milled slots, and/or a density gradient within the panel, wherein the detachable protruding lip is configured to be detached and removed so as to provide a remaining portion of the panel having a complementary shape with a predetermined break-off surface for receiving a protruding lip of a neighbored panel, where the neighbored panel is identical to the panel with the protruding lip.

2. The panel of claim 1, wherein the detachable protruding lip of the panel comprises at least one horizontal locking element configured to alternatively engage in a horizontal locking groove of the neighbored panel, wherein the protruding lip of the neighbored panel has been removed.

3. The panel of claim 2, wherein the horizontal locking element retains the neighbored panel in a vertical and/or a horizontal direction.

4. The panel of claim 1, wherein at least two detachable protruding lips are fixed at opposite sides of the panel.

5. The panel of claim 1, wherein all of the front ends are protruded with respect to the perimeter by the detachable protruding lip formed at the lower side.

6. The panel of claim 1, wherein a vertical locking groove is incorporated in the at least one of the front ends.

7. The panel of claim 1, wherein the panel comprises one or more materials selected from the group consisting of MDF, HDF, cork, OSB, solid wood, plywood, plastics, PVC, cement fibers, basalt, rock wool, ceramics, genuine stone, metal, aluminum or steel panel, glass, plastics, chipboard, and laminate floorboards.

8. The panel of claim 1, wherein the at least one of the front ends comprises at the upper side a vertical locking groove over the whole length of the at least one of the front ends or at least over parts of the length of the at least one of the front ends.

9. The panel of claim 2, wherein a vertical locking groove is formed at the horizontal locking element, said vertical locking groove configured to accommodate a vertical locking element.

10. The panel of claim 1, wherein the panel has a rectangular shape, and the length of the panel is an integer multiple of the width of the panel.

11. The panel of claim 1, wherein the predetermined break-off surface is formed by one start notch of the one or more start notches and one end notch, wherein the one end notch is arranged in the horizontal locking groove.

12. The panel of claim 1, wherein the detachable protruding lip of the panel comprises MDF, HDF, and/or a plastic and, wherein a core of the panel comprises MDF, HDF, PVC, a plastic and/or any mixture thereof.

13. The panel of claim 1, wherein the break-off surface of the protruding lip is beveled.

14. The panel of claim 1, wherein a start notch of the one or more start notches is oriented in a vertical distance in a range from 0.1 to 10 mm above an upper lip surface for forming a crack gap.

15. A method for manufacturing wall-, ceiling- and/or floor coverings comprising a plurality of panels including a first panel and a neighbored panel, wherein each of the panels comprises:

an upper side, a lower side, and a plurality of front ends, the upper side, the lower side and the front ends defining a perimeter of the panel in the installed state;

a detachable protruding lip formed at the lower side, wherein the detachable protruding lip protrudes from at least one of the front ends with respect to the perimeter; and one horizontal locking groove at the lower side, wherein the detachable protruding lip of the first panel is configured to be detached and removed so as to provide a remaining portion of the first panel having a complementary shape with a predetermined break-off surface for receiving the protruding lip of the neighbored panel, where the neighbored panel is identical to the panel with the protruding lip, and, wherein the method comprises connecting the first panel at the front end comprising the detachable protruding lip with the at least one of the fronts end of the neighbored panel by removing the protruding lip of the first panel at the predetermined break-off surface and by joining the protruding lip of the neighbored panel with the first panel.

16. The method of claim 15, wherein the protruding lip of the first panel comprises at least one horizontal locking element configured to alternatively engage in the horizontal locking groove of the neighbored panel whose protruding lip has been removed, wherein during joining, the horizontal locking element is incorporated in the horizontal locking groove.

17. The method of claim 15, wherein the first panel and the neighbored panel each has a vertical locking groove at one of their front ends and prior to joining, an insertable locking element connecting the vertical locking grooves is introduced in the vertical locking grooves.

* * * * *